US006422805B1

(12) United States Patent
Miller

(10) Patent No.: US 6,422,805 B1
(45) Date of Patent: Jul. 23, 2002

(54) QUICK COUPLER FOR BUCKET EXCAVATORS

(76) Inventor: Gary Miller, 42 Wentworth Drive, Usworth, Washington Tyne and Wear NE27 1PX (GB)

( * ) Notice: Subject to any disclaimer, the term of this patent is extended or adjusted under 35 U.S.C. 154(b) by 0 days.

(21) Appl. No.: 09/337,447

(22) Filed: Jun. 21, 1999

(30) Foreign Application Priority Data

Sep. 8, 1998 (GB) ..... 9819598

(51) Int. Cl.[7] ..... E02F 3/32
(52) U.S. Cl. ..... 414/723; 37/468
(58) Field of Search ..... 414/723; 37/468; 403/320, 321, 325; 172/272–275

(56) References Cited

U.S. PATENT DOCUMENTS

| | | | | |
|---|---|---|---|---|
| 4,871,292 A | | 10/1989 | Milanowski | |
| 4,929,143 A | * | 5/1990 | Dohnalik | 172/272 X |
| 5,244,047 A | * | 9/1993 | Eudy | 172/275 |
| 5,332,353 A | * | 7/1994 | Arnold | 172/275 X |
| 5,549,440 A | * | 8/1996 | Cholakon et al. | 414/723 |
| 5,692,325 A | | 12/1997 | Kuzutani | |

FOREIGN PATENT DOCUMENTS

| | | |
|---|---|---|
| EP | 0 122 547 A1 | 10/1984 |
| EP | 0 405 813 A2 | 1/1991 |
| EP | 0 578 447 A1 | 12/1994 |
| FR | 2 701 047 A1 | 5/1994 |
| FR | 2 760 029 A1 | 2/1997 |
| GB | 2205299 A | 12/1988 |
| WO | WO 95/33895 | 12/1995 |

* cited by examiner

*Primary Examiner*—Donald W. Underwood
(74) *Attorney, Agent, or Firm*—Stephen B. Salai, Esq.; Brian B. Shaw, Esq.; Harter, Secrest & Emery LLP

(57) ABSTRACT

A coupler for connecting a dipper arm of an excavator to a bucket without the need for the operator of the excavator to leave the cab of the excavator, the coupler having means for connecting it to the end of the dipper arm, and means, including a latching hook for connecting it to one of a plurality of different buckets and wherein locking means is provided to prevent inadvertent unlatching of the latching hook, said locking means being operable from the cab. The locking means may be gravity operated and include resiliently deformable means thereon to prevent unlatching when the coupler is inverted. Alternatively, it may be spring operated in which case, further means is provided to move the locking means against the bias of the spring. Preferably, the hook has a special internal profile so that when it is supporting the weight of a bucket, it will tend to move to a latching position, not to an unlatching position.

4 Claims, 12 Drawing Sheets

QUICK COUPLER FOR BUCKET EXCAVATORS

Figure 1:
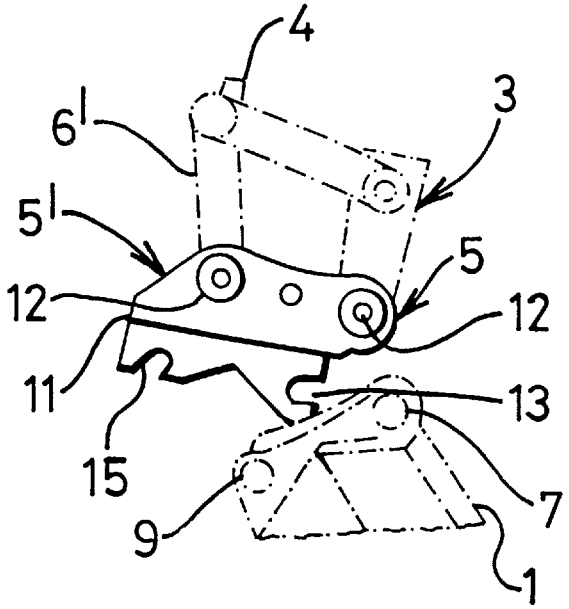
FIG. 1 (Prior art)

This invention relates to a quick coupler for bucket excavators.

Hydraulically operated mechanical excavators have a dipper arm on the end of which are two mounting points by means of which an excavating bucket is pivotally attached to the end of the arm, and pivoted relative to the arm, respectively. Until relatively recently, if the operator wished to change the bucket, e.g. to a larger one, this had to be done manually. This involved the operator leaving the cab of the excavator, removing two pivot pins by means of which the bucket is connected to the dipper arm, getting back into the cab to lift the dipper arm clear of the bucket, aligning the dipper arm with the new bucket (and aligning the pivot apertures), de-mounting from the cab again, and locating the pivot pins in the aligned apertures, and securing them in place (e.g. with circlips, locking pins or bolts or the like) and then getting back into the cab to use the excavator. Sometimes, the operator would have considerable difficulty in removing or re-inserting the pivot pins, due to slight misalignment of the pivot apertures, and would have to use a heavy hammer for this purpose.

More recently, this time consuming exercise has been largely dispensed with, with the introduction of quick couplers which are located between the dipper arm and the bucket. The couplers can either be of the hydraulic type or of the mechanical type and are effectively permanently fitted to the two pivot apertures of the dipper arm and the bucket pivoting link, respectively. These couplers incorporate a generally horizontally and rearwardly extending hook-like aperture or jaw adapted to engage with one of the pivot pins on the bucket (both of which are left fitted to the bucket), and a generally downwardly extending aperture or jaw adapted to locate over the other pivot pin on the bucket, with which downwardly extending aperture a moveable latching hook is associated.

In the manual version of the coupler, this latching hook is biased by a coil spring to its latching position, and is moved away from its latching position by a release handle or lever rod which is removably locatable in an aperture in the nose of the latching hook.

In the hydraulic version, a double acting hydraulic piston and cylinder device moves the latching hook between its respective positions, and check valves are located within the piston and cylinder device to prevent inadvertent movement of the piston in the event of hydraulic failure.

However, in both the manual and hydraulic versions, a safety pin has to be provided which must be located by the excavator operator in specially provided apertures in the coupler, to lock the latching hook in its latching position. This means that in both of these versions, the digger operator still has to leave his cab to secure in position the safety pin; this is inconvenient and time consuming.

In FR 2760029 and FR 2701047, couplers with hydraulically operated latching hooks are disclosed. However, these couplers are not provided with latch locking devices which can be operated from within the cab of the excavator.

It is an object of the present invention to provide a fully automatic coupler for an excavator bucket which can be operated by the excavator operator from his cab and be locked in its latching position without the operator having to leave the cab.

According to the present invention, we provide a coupler to enable an excavator operator to couple an excavator bucket to a dipper arm of an excavator without leaving his cab, the coupler comprising two spaced side plates each having four fixed pin location points, the coupler being mountable in use between the bucket and the dipper arm and comprising a first aperture and a second aperture defining two of said points and connectable respectively, in use, to the dipper arm of the excavator and a bucket piston and cylinder device, by suitable pins, a first open-ended hooklike aperture defining a third of said points and for engagement with a first pivot pin provided on an excavator bucket, and a pivoting latching hook co-operating with a second open-ended aperture defining said fourth point and for latching engagement with a second pivot pin provided on the bucket once the first hook-like aperture has been engaged with the first pivot pin, in use, power operated means for moving the latching hook between latching and unlatched positions and operable by the operator from the cab, and blocking means adjustably supported on the body of the coupler and moveable from within the cab of the excavator independantly from the latching hook from and into a blocking position in which it prevents the latching hook from being disengaged from the second pivot pin on the bucket.

In one preferred construction, the blocking means is moveable under its own weight by the force of gravity into a latch blocking position in which it prevents the latching hook from being disengaged from the second pivot pin on the bucket, and resiliently deformable means is provided on the blocking means which, in use, will engage an abutment when the coupler is inverted by rotation in one sense (with the result that the blocking means will tend under its own weight to move away from its blocking position) such engagement resulting in the resiliently deformable means biasing the blocking means into its latch blocking position.

In this construction, by inverting the coupler, the blocking means will move, under its own weight, to a fully crowded position in which it no longer blocks the latching hook.

Alternatively, a spring may be provided permanently to bias the blocking means into its blocking position, and means is provided to move the blocking means against the bias of the spring, so that it no longer blocks the latching hook. In one arrangement, said means is provided by a wire and pulley arrangement, the wire of which will tighten when the coupler is inverted, i.e. on full curl of the bucket, to move the blocking means out of its blocking position.

In an alternative construction, a small hydraulic cylinder could be provided to move the blocking means out of its blocking position, against the bias of the spring.

Preferably, the latching hook is operated by means of a double acting piston and cylinder device, one end of which is pivotally connected about a first pivot axis to the coupler, and the other end of which is pivotally connected to the latching hook.

In one construction, the blocking means comprises a bifurcated blocking bar, the two limbs of which are pivotally supported on the coupler, preferably on the said first pivot axis, and the opposite end of which bears against a face on the rear of the latching hook.

In another construction, the blocking means may comprise a single blocking bar pivotally supported at one end region on the coupler, preferably on the first pivot axis and adapted to bear at its opposite end against a face on the rear of the hook.

Preferably, the face is stepped so that the coupler can be used with different sized bucket pivot pin distances (known as pin spread).

Preferably, the resiliently deformable means comprises an upstanding resiliently deformable arm on the blocking bar which will bear against an abutment on the dipper arm when the coupler is inverted, e.g. when a bucket operating cylinder is retracted to pivot the bucket.

Preferably, a protection plate is fitted over the latching hook and blocking means, through which plate the resiliently deformable arm projects, the plate being provided to ensure that excavated material does not interfere with the operation of the blocking means. The plate may be welded or bolted in position. Hydraulic hoses for the double acting piston and cylinder device for operating the latching hook preferably pass through one or more apertures in the plate, but alternatively the plate may carry two hydraulic hose couplings and on the inner side of the plate, the couplings are permanently connected by suitable hoses to the said piston and cylinder device. This allows further hoses leading from the main pressure system on the excavator to be connected and disconnected easily to the coupler.

The spring for biasing the blocking means into its blocking position (if provided) may be located between the protection plate and the blocking means.

Although the piston and cylinder device for the latching hook is provided with a check valve and the blocking means is provided, it is important that maximum provision is made to ensure that a bucket cannot accidentally become disconnected from the coupler, and preferably therefore, the latching hook is designed so that it will not rotate to a release position when under load, or when there is a hydraulic failure in the piston and cylinder device controlling the hook, and when the blocking means has failed.

In the known coupler, the hook has a profile which is such that, under the above conditions, and the hook is carrying the weight of the bucket, the forces acting on the pin are such that there is a moment about the pivot supporting the hook which will cause the hook to rotate to its unlatched position, thus releasing the bucket.

In the present invention, we preferably provide a hook which has a profile such that under the above conditions, and when the hook is carrying the weight of the bucket, and there would otherwise be a tendency for the hook to rotate to a release position, the pin will move along the internal concave surface of the hook, from a first position tending to unlatch the hook to one putting no unlatching force on the hook and thereafter to one tending to move the hook to a latching position.

For this purpose, the free end of the hook preferably has an upturned, extended nose, the inner face of which is concave and which is preferably connected to the normal concave internal surface of the hook by an internal planar portion.

Figure 2:
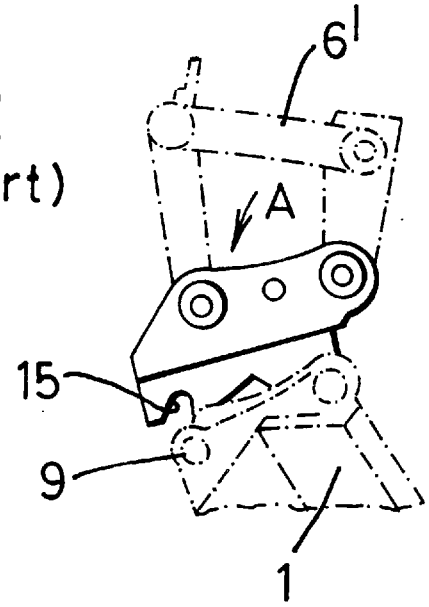
FIG. 2 (Prior art)
Figure 3:
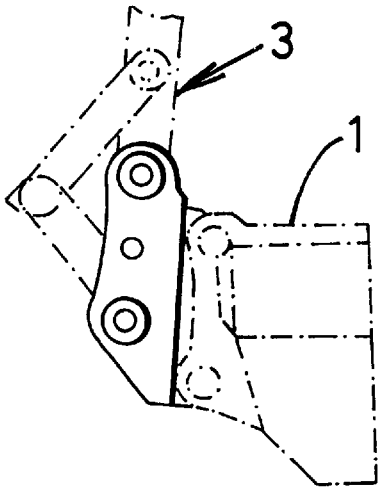
FIG. 3 (Prior art)
Figure 4:
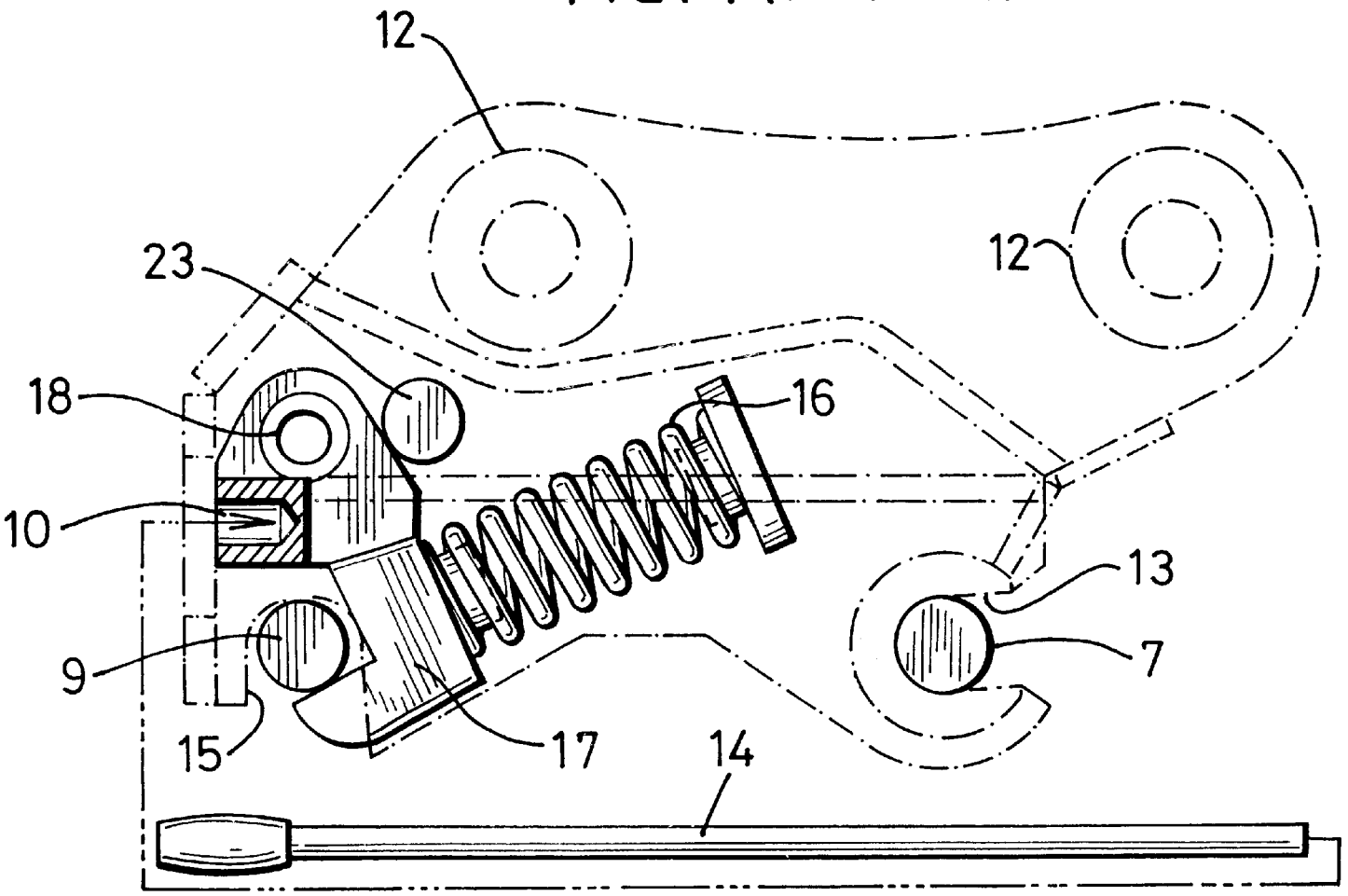
FIG. 4 (Prior art)
Figure 5:
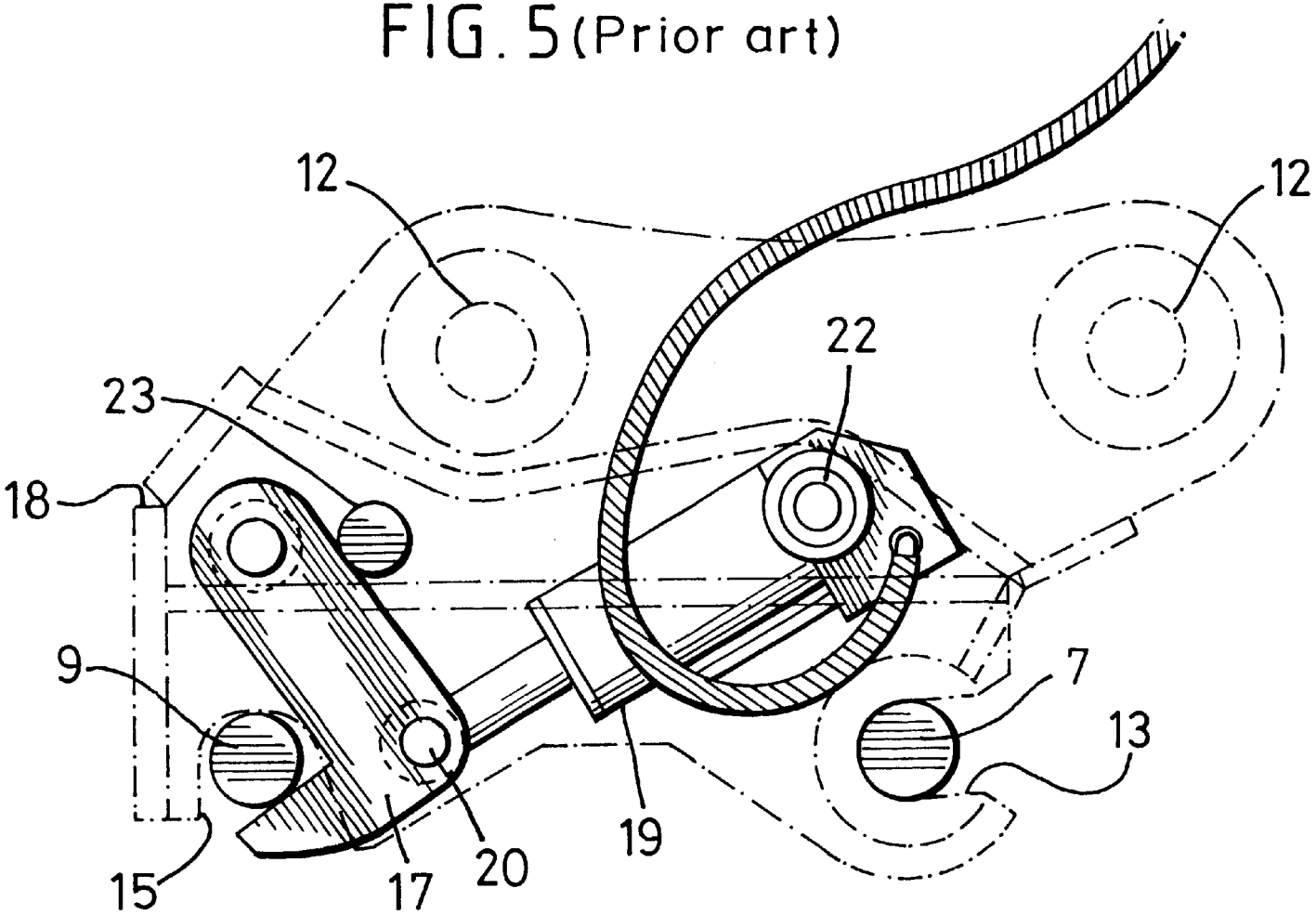
FIG. 5 (Prior art)
Figure 6:
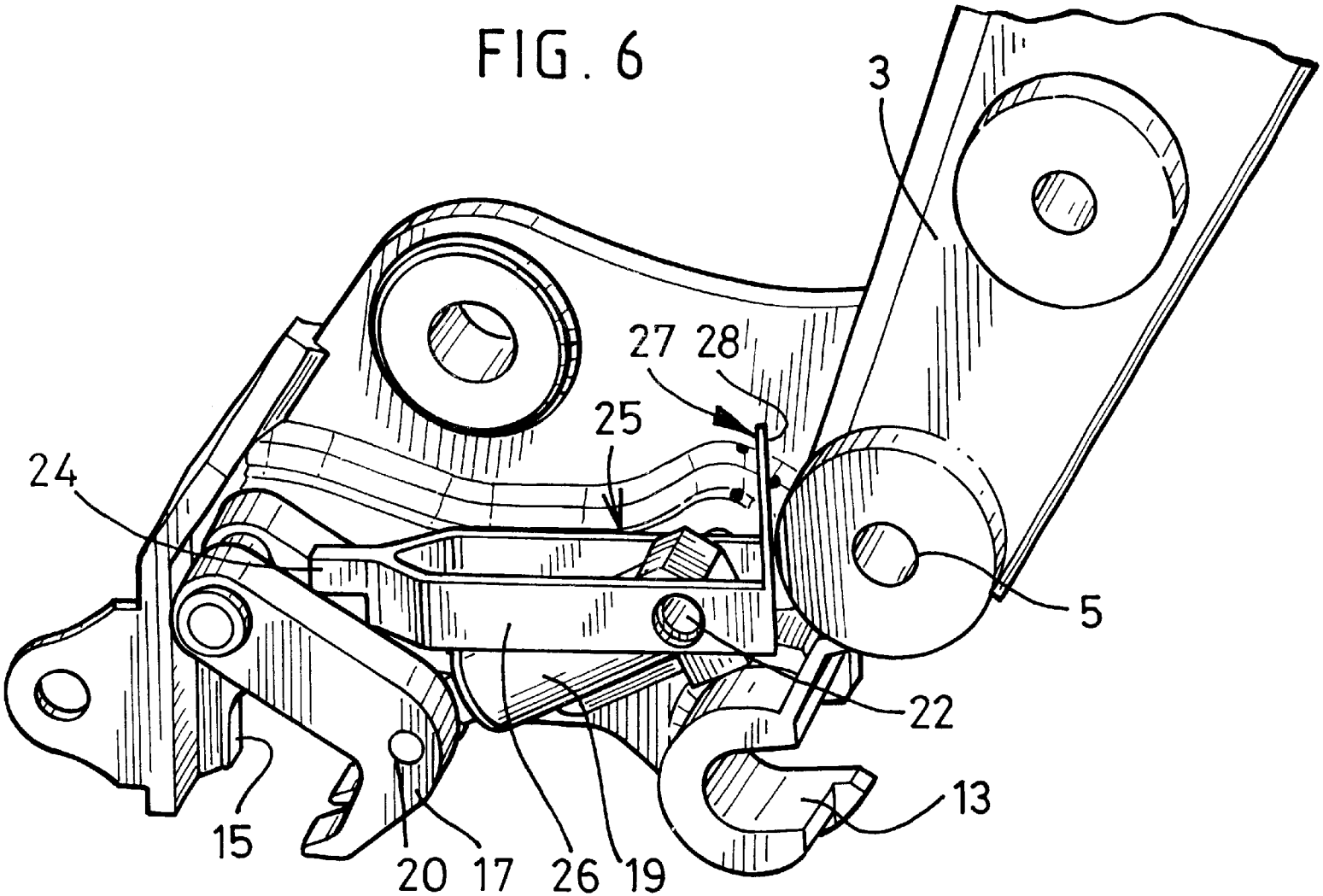
Figure 7:
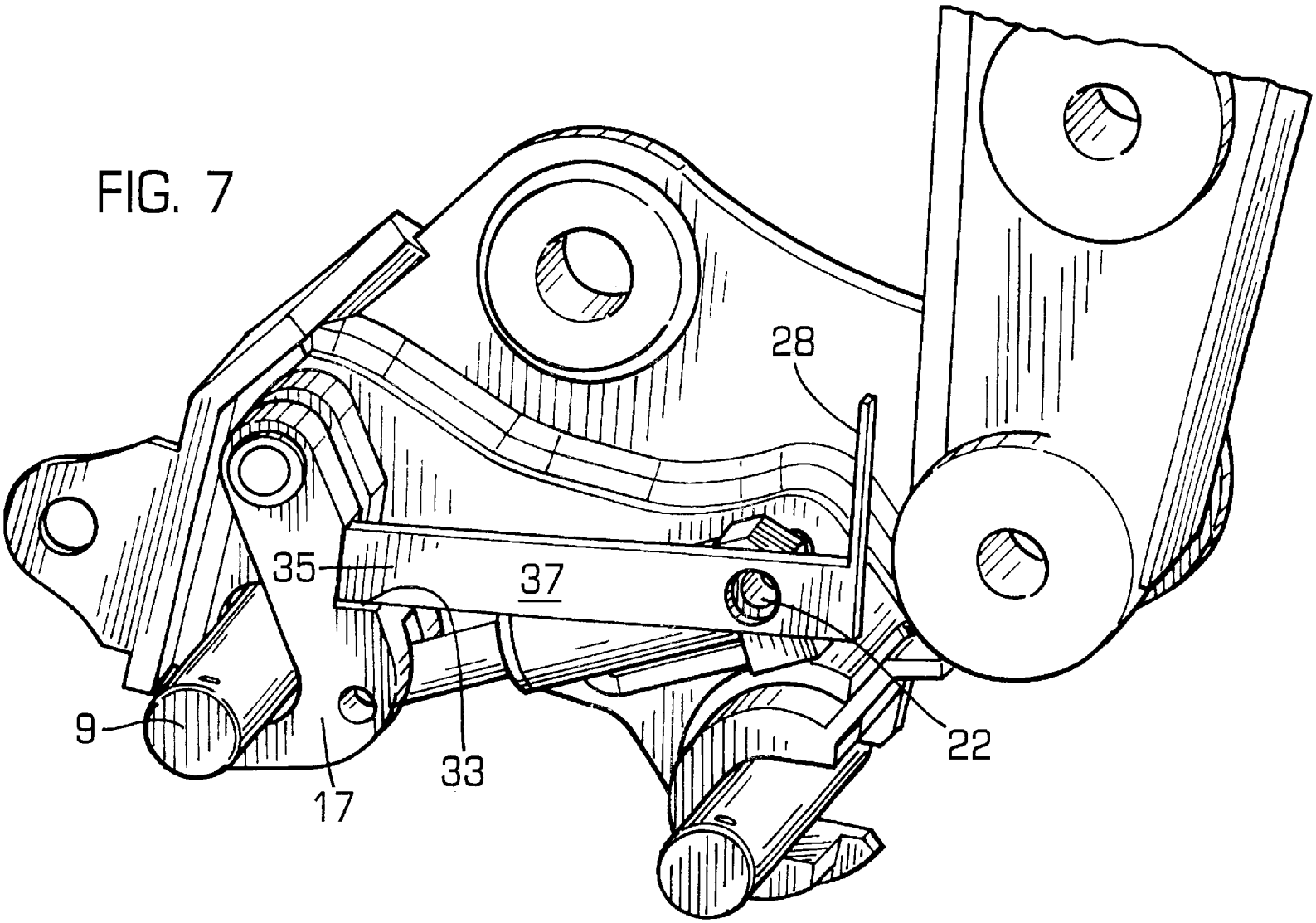
Figure 8:
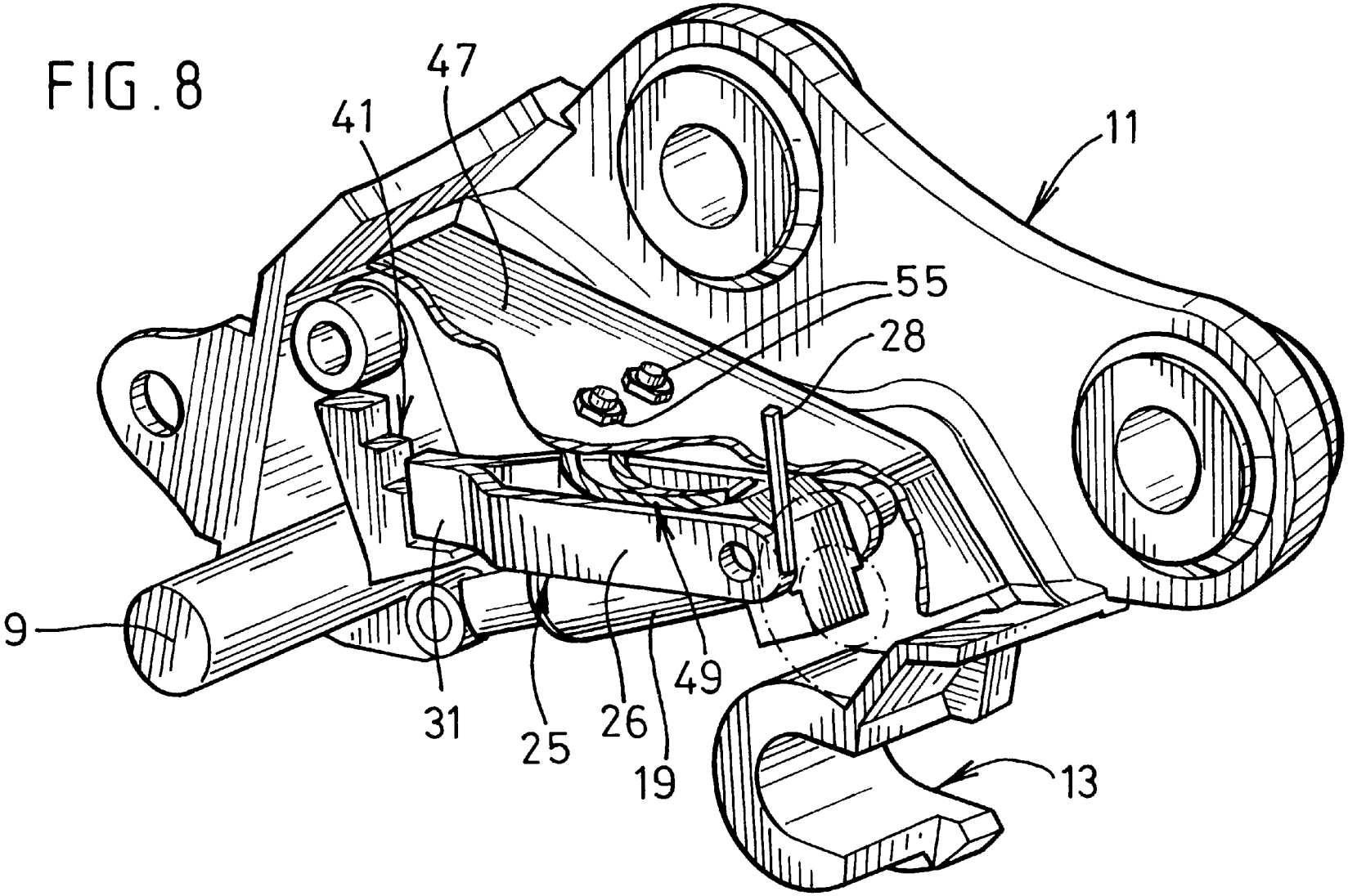
Figure 9:
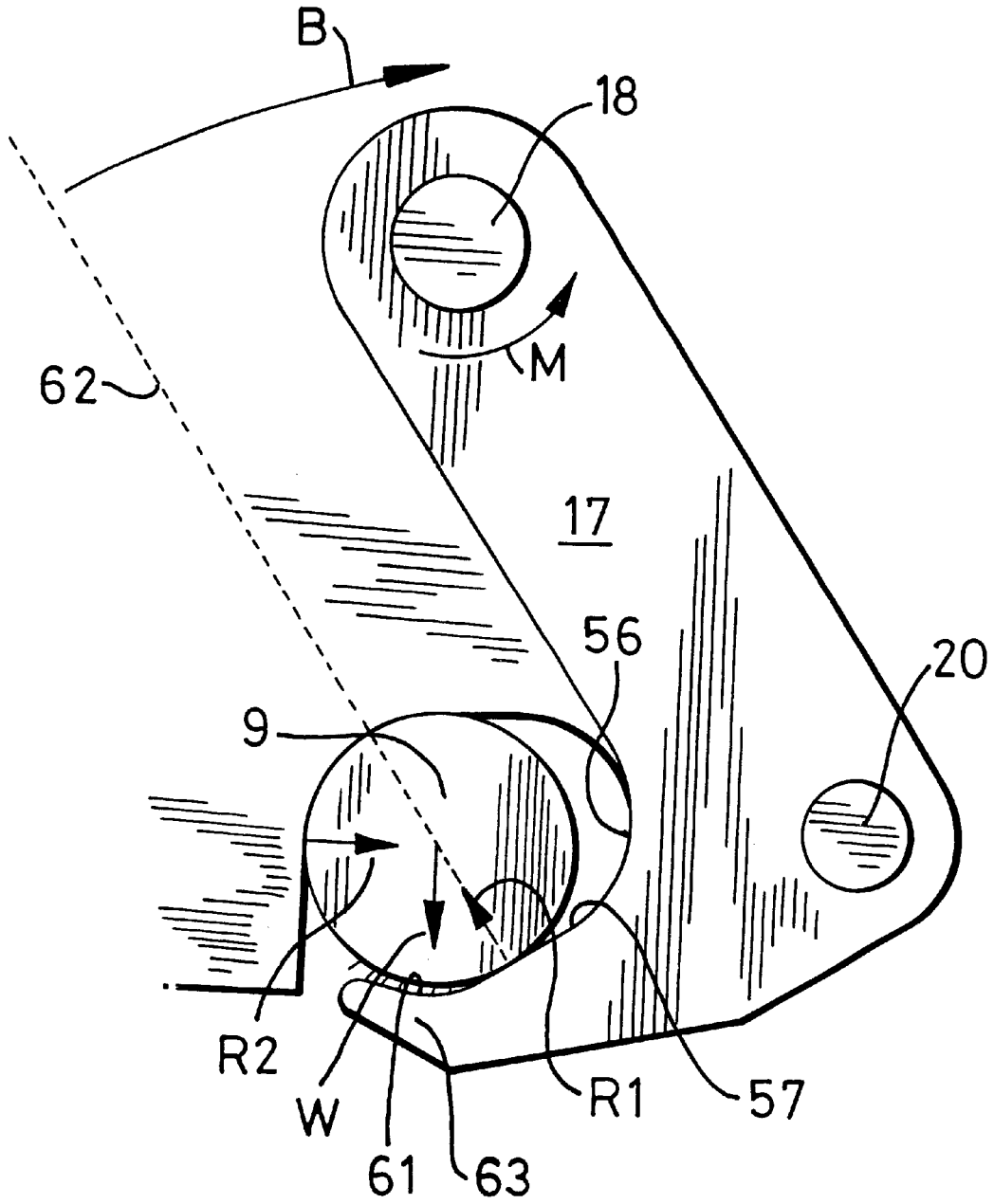
Figure 10:
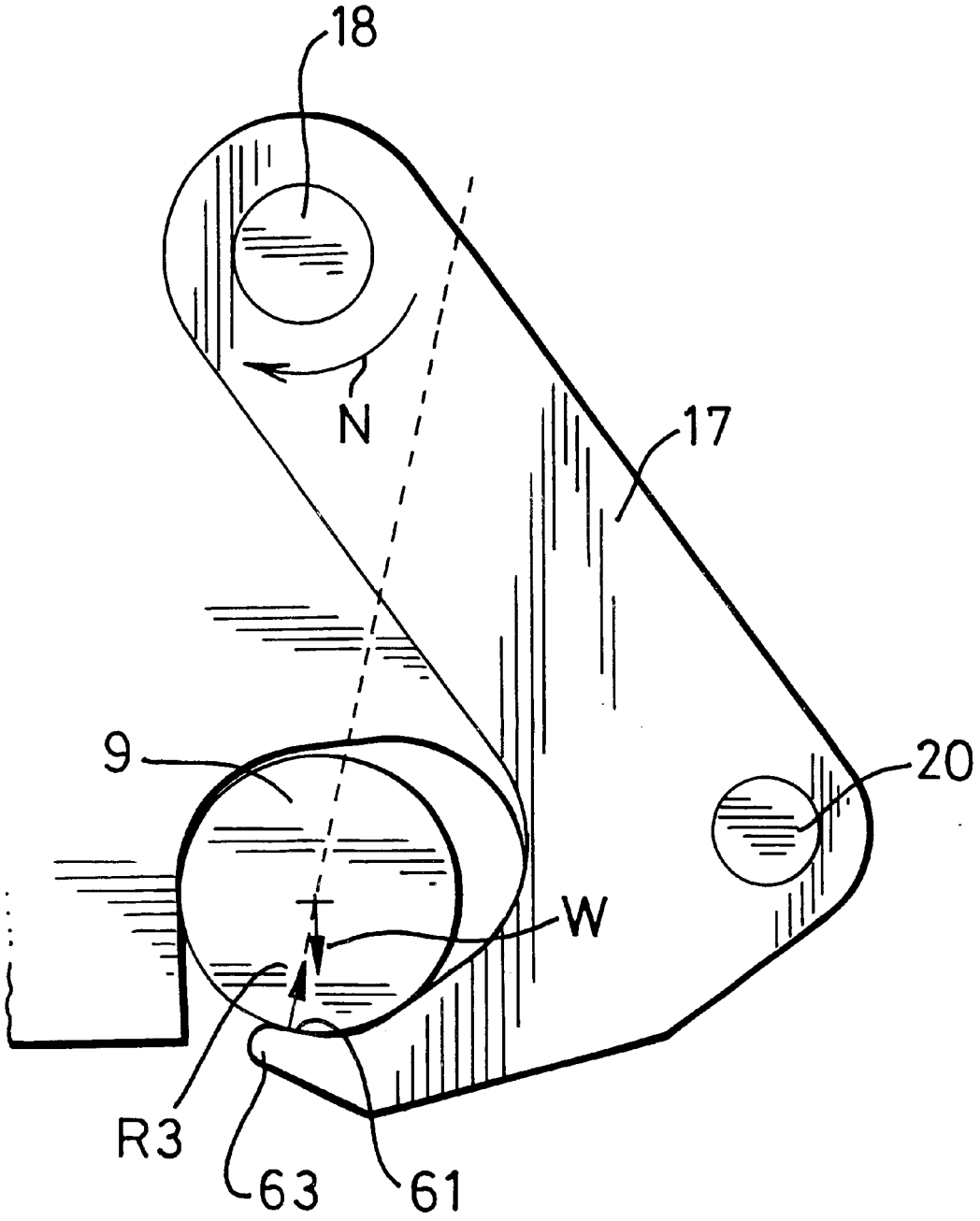
Figure 11:
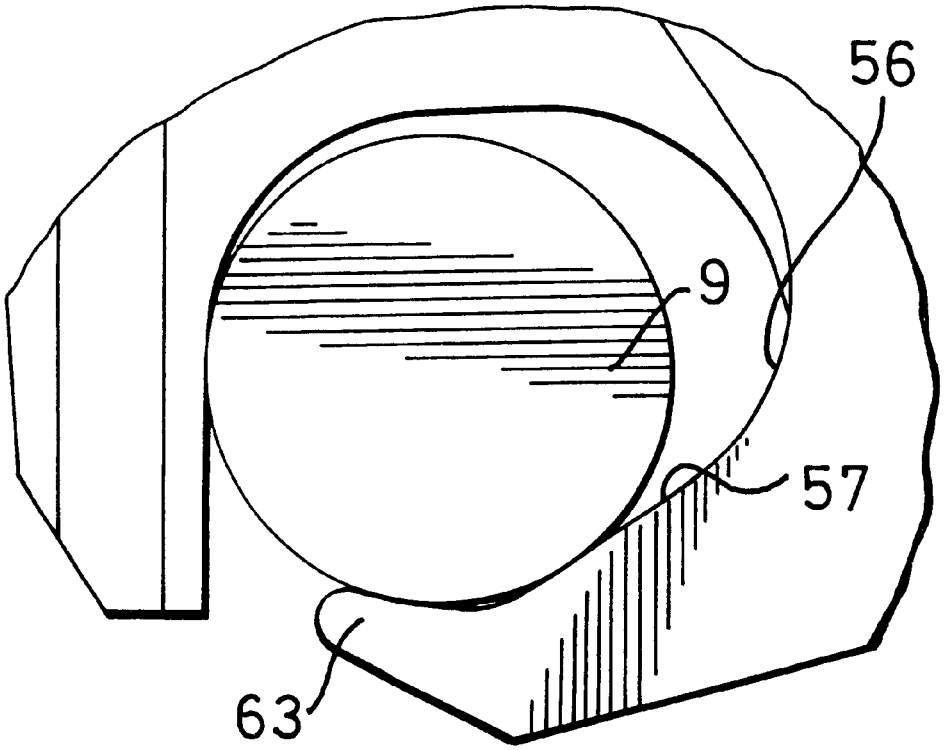
Figure 12:
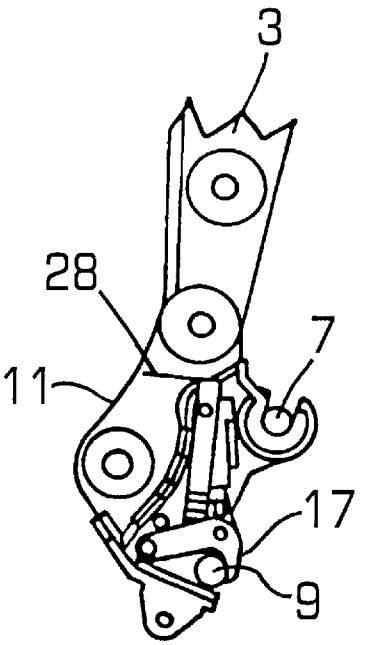
Figure 12:
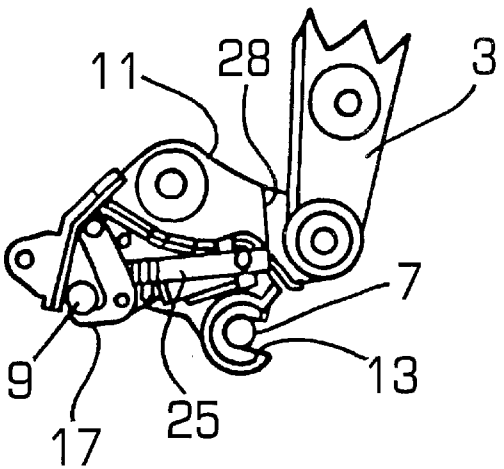
Figure 12:
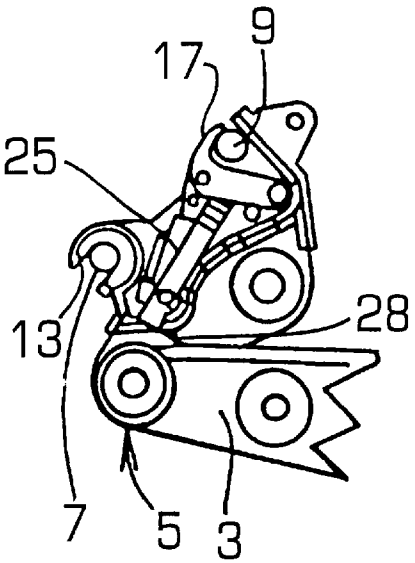
Figure 12:
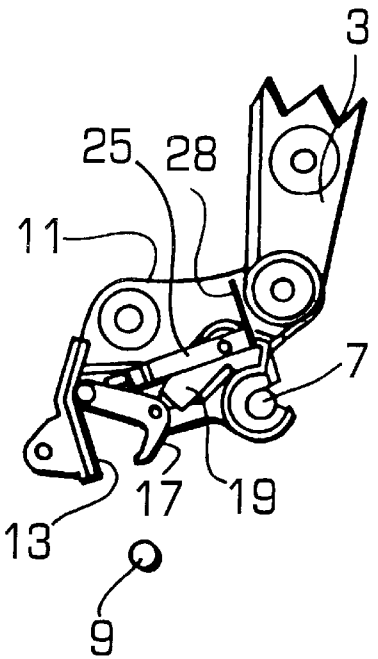
Figure 12:
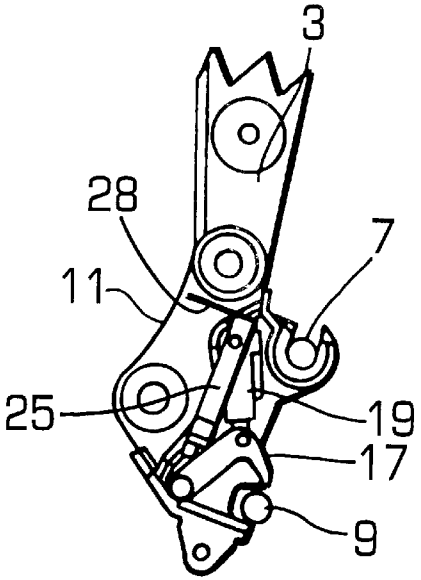
Figure 12:
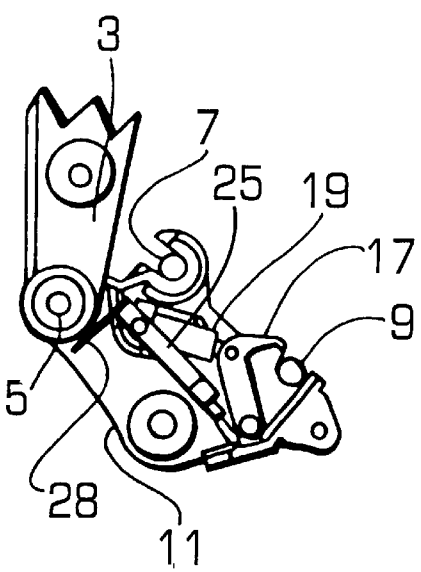
Figure 13:
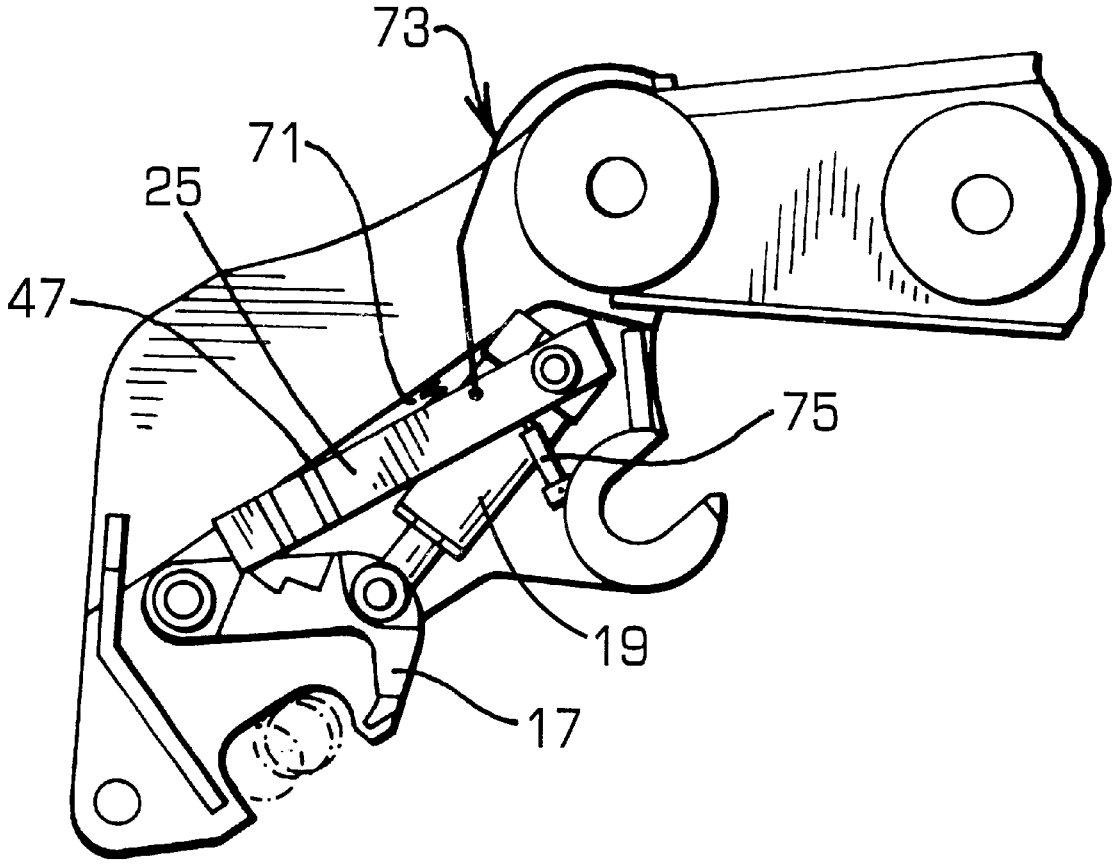

Several preferred embodiments of coupler according to the present invention are now described by way of example with reference to the accompanying drawings, in which:

FIGS. 1 to 3 are schematic side elevations showing how a coupler is used to connect an excavator bucket to a dipper arm of an excavator, FIG. 4 is a partly schematic side elevation with parts broken away, showing details of a manual prior art coupler, FIG. 5 is a view similar to FIG. 4 of a hydraulically operated prior art coupler, FIG. 6 is a perspective view with parts broken away showing a first embodiment of coupler according to the invention, FIG. 7 is a view similar to FIG. 6 showing a second embodiment of coupler according to the invention, FIG. 8 is a further perspective view with parts cut away showing two further preferred features of the invention, FIG. 9 is a scrap view showing a coupler latching hook according to a preferred feature of the invention, FIG. 10 is a view similar to FIG. 9, but showing the hook with the bucket pin in a slightly different position, FIG. 11 is an enlarged view showing the hook and pin in its FIG. 10 position, FIG. 12 shows schematically six different relative orientations of an excavator dipper arm, coupler and excavator bucket, and FIG. 13 is a view similar to FIGS. 6–8, but showing the coupler in a different position, and showing two possible alternative constructions.

Referring to FIGS. 1 to 5 of the drawings, an excavator bucket is shown at 1, and the distal end of an excavator dipper arm is shown at 3. In accordance with standard practice, the dipper arm 3 supports a bucket piston and cylinder device 4 for controlling the bucket 1 via two pivot links 6', the bucket I normally being connected directly to the dipper arm 3 by means of a first pivot pin 7 carried by the bucket and engaging directly within a mounting point or pivot aperture in an end region of the dipper arm 3 and a second pivot pin 9 engaging directly within a mounting point or pivot aperture 5' in an end region of one of the links 6' (this arrangement is not shown).

More recently, however, a coupler II has been used to enable the semi-automatic connection of the bucket 1 to the dipper arm 3 and as illustrated, the coupler has two mounting points thereon by means of which it is connected to the mounting points 5 and 5' on the dipper arm 3 and on the link 6' respectively, by suitable connecting pins 12. The coupler 11 is provided in a lower region thereof with a first generally horizontally and rearwardly extending aperture or jaw 13 and a second generally downwardly extending aperture or jaw 15. By rearwardly extending, we mean opening outwardly, in use, from the coupler towards the operator of an excavator on which the dipper arm 3 and coupler 11 are fitted and by downwardly extending we mean, in use, extending or opening outwards generally downwards towards the ground. In order to connect the bucket I to the dipper arm, the excavator operator manoeuvres the dipper arm to the position shown in FIG. 1 and then moves the dipper arm downwardly and rearwardly so as to engage the first aperture or jaw 13 with the first pivot pin 7, which is virtually permanently fitted to the bucket 1; he then operates the bucket-controlling piston and cylinder device 4 so as to swing the pivot links 6' downwardly, as represented by t he arrow A in FIG. 2, so as to move the second aperture or jaw 15 into engagement with the second pivot pin 9, which is also virtually permanently secured to the bucket 1. The coupler is then latched in position so that the jaw 15 is clamped around the pin 9 and the bucket can be used for digging as illustrated in FIG. 3.

In FIG. 4, a manual prior art coupler is disclosed which is provided with a latching hook 17, pivotally supported on the body of the coupler about a pivot 18 and biased to a latching position (in which it maintains the pivot pin 9 in the aperture 15) by means of a coil spring 16. In order to move the hook 17 against the bias of the spring 16, e.g. to release the pivot pin 9 from the aperture 15 and thus to drop a bucket 1, a bar or release handle. 14 has to be inserted into an aperture 10 in a nose portion of the hook 17 so that when downward pressure is applied to the end of the bar, the hook 17 will pivot about its pivot 18 accordingly.

In the hydraulic type of prior art coupler which is illustrated in FIG. 5, the latching hook 17 is moved between its illustrated latching position and a release position by means of a double-acting hydraulic piston and cylinder device 19, the piston of which is pivotally connected to the hook at 20 and the cylinder of which is pivotally connected to the body of the coupler at 22. A suitable check valve (not shown) is provided within the piston and cylinder device 19 in case there should be a failure in the hydraulic supply to the piston and cylinder device 19. However, in case this check valve should fail, or in the case of the manual coupler shown in FIG. 4, in case the spring 16 should fail, a safety pin 23 is always provided. This safety pin 23 bridges between the body or two side plates of the coupler 1 and a rear face of the latching hook 17 so as to hold the latching hook 17 in a latching position and prevent the bucket pivot 9 from being released from the aperture 15. The disadvantage with this arrangement is that every time the safety pin 23 has to be inserted or removed, the excavator operator has to dismount from the cab of the excavator. This is time consuming and inconvenient for the excavator operator and as a result, the operator often never fits the safety pin 23.

In accordance with the present invention, automatically operating blocking means is provided to overcome this problem. In the first embodiment of coupler as shown in FIG. 6, wherein parts of the coupler have been broken away for the sake of clarity, the safety pin of the prior art construction shown in FIG. 5 is dispensed with and replaced with a blocking means shown generally at 25. The blocking means is in the form of a bifurcated blocking bar with two rearwardly extending limbs 26 which are pivotally supported on the pivot 22 by means of which the piston and cylinder device 19 is connected to the coupler 11, and a forward end 24 of which engages within a recess on a rear face of the latching hook 17. The blocking means 25 moves into blocking engagement with the rear face of the latching hook 17 under its own weight due to the force of gravity, causing it to pivot anticlockwise about the pivotal connection 22 under normal operating conditions of the coupler and excavator bucket. However, in the event of the bucket operating piston and cylinder device 4 being retracted so as to lift the bucket so as to pivot it clockwise about the mounting point 5 on the dipper arm 3, there will be a tendency for the blocking means 25 to become inoperative due to its own weight and accordingly, the blocking means 25 is provided on its rearmost end with resiliently deformable means 27 which is then activated to bias the forward end 24 of the blocking means into engagement with the rear face of the latching hook 17. This will hold the hook in its latching position to prevent inadvertent displacement of the second bucket pivot pin 9 from the aperture 15. In the preferred arrangement, the resiliently deformable means 27 is in the form of an upstanding leaf-spring 28, a free end portion of which will abut against an abutment on the dipper arm 3, thus producing a suitable reaction force to hold the blocking means 25 in engagement with the rear face of the hook 17.

In the alternative preferred embodiment shown in FIG. 7, the bifurcated blocking bar with its two limbs 26 is replaced by a single blocking bar 37, which is pivotally connected to the pivot connection 22, as in the previous embodiment. Likewise, as in the previous embodiment, this single blocking bar 37 has an upstanding leaf-spring 28 connected thereto which operates as previously described. In the embodiment of FIG. 7, a forward end portion 35 of the blocking bar engages within a recess 33 in a rear face of the latching hook 17 to hold the latching hook 17 in its latching position but in other respects, the single blocking bar 37 acts in the same way, under its own weight, as in the previous embodiment.

In a preferred arrangement of the embodiment shown in FIG. 8, a series of steps or recesses 41 are provided on a rear face of the latching hook 17 with which a modified forward end portion 31 of the blocking means 25 engage. As will be apparent from FIG. 8, the bucket pivot pin 9 shown therein is of a normal size, but by providing the series of steps on the rear face of the latching hook 17, larger sizes of bucket pin 9, or different-sized bucket pin pivot centres (known as pin spread) can be accommodated.

From the foregoing, it will be appreciated that the gravity operated blocking means 25 whether it be the embodiment shown in FIG. 6 or the embodiment shown in FIG. 7, or that shown in FIG. 8, allows an excavator operator to change buckets without leaving his cab. This is because the latching hook 17 is hydraulically actuated by means of the piston and cylinder device 19, which itself is provided with check valves to prevent movement of the piston therein in the event of hydraulic failure. However, even if there is a hydraulic failure and, the check valves also fail, then the blocking means 25 will still prevent the latching hook 17 moving to an unlatched position.

When the excavator operator wishes to change a bucket, it is necessary for the operator fully to extend the piston and cylinder device 4 for the bucket to rotate the coupler anticlockwise (as seen in the drawings) so as to move the bucket into a filly inverted position, wherein it is tucked beneath the dipper arm 3 (sometimes known as the crowd position) in which position the coupler 11 will be inverted and the blocking means 25 will then swing under its own weight due to the forces of gravity to an unblocking position. This will then allow the operator to retract fully the piston of the piston and cylinder device 19, thus moving the latching hook 17 to an unlatched position. When the bucket is in this position, its weight will be supported largely completely on the back of the bucket 1 and the operator can then by retracting the main bucket operating piston and cylinder device 4, roll the coupler 11 to a generally vertical position, thus allowing the second bucket pin 9 to swing out of the second aperture or jaw 15 (which is now generally rearwardly extending) whereupon, on further retraction of the piston and cylinder device 4, the coupler 11 will be moved back to its normal position, thus allowing the first pivot pin 7 to slide out of the rearwardly facing first aperture 13. This effectively disconnects the bucket from the coupler and allows the operator then to fit a different bucket to the dipper arm. These various different relative positions of dipper arm, coupler and excavator bucket are illustrated in the six different views comprising FIG. 12 of the drawings.

Because of the provision of the gravity operated blocking means 25, it is important to ensure that excavated material does not interfere with its satisfactory operation. Accordingly, we prefer to fit a protection plate 47 between the two side plates of the coupler 11, which completely overlies the blocking means 25 and the double acting hydraulic piston and cylinder device 19, as shown in FIG. 8. This plate 47 is preferably welded in position and accordingly, has an aperture therein through which the resiliently deformable leaf-spring 28 projects. Furthermore, two hydraulic hose connectors are fitted to the plate, as shown at 55, to which hydraulic hoses 47 for the piston and cylinder device 19 are connected. On the upper exposed face of the plate, the connectors 55 are provided with fittings to receive connectors from further hydraulic hoses (not shown), which are secured to the dipper arm 3 and lead to the main pressure system on the excavator. Although the presence of the protection plate 47 prevents the ingress of excavated material to the interior of the coupler, the provision of the hydraulic connectors 55 still allows the coupling 11 to be disconnected from the dipper arm if required and when various parts of the coupler become worn, these can all simply be removed by dropping them downwardly from the coupler as shown in FIG. 8, since all the various pivot connections are easily removable from the coupler.

In spite of the various safety features described above, all enabling bucket exchange to be carried out from the cab of the excavator, there is still a slight risk that the latching hook 17 may swing to its unlatching position, thus allowing the bucket to be dropped from the dipper arm if there is a hydraulic failure, and the check valve in the piston and cylinder device 19 fail, and the gravity operated blocking means 25 fails for some reason or another. Accordingly, we prefer to provide a modified latching hook which, under normal conditions, cannot swing to an unlatched position, due to the weight of the bucket pivot 9 thereon. This modified latch hook is shown in FIGS. 9, 10 and 11.

Normally, with a latch hook such as shown in FIG. 7 or FIGS. 4 and 5, the weight of the bucket on the hook, which is transferred to the hook through the bucket pin 9, will cause the hook to swing anticlockwise, due to the reaction force R1, acting on the inner concave face of the hook, causing an anticlockwise moment represented by the arrow M, shown in FIG. 9. However, as is shown in FIG. 9, the preferred hook of the invention instead of simply having an internal profile such as shown schematically in FIGS. 4 and 5, is provided not only with a first concave portion 56 and a planar portion 57, both of which are generally of known construction, but also with a second concave portion 61, by virtue of the presence of a nose portion 63 on the free end portion of the hook 17. As can be seen from FIG. 9, when the bucket pin 9 is bearing down upon the first concave portion 56 of the hook, there will be reaction forces generated such that the moment acting on the hook 17 about its support pivot 18 is anticlockwise. However, as the coupler is tipped during operation, so that there is a tendency for the bucket 9 to move off the first concave surface 56 and onto the planar surface 57, reaction forces R1 and R2 will be generated, the two components of which, when combined, will eventually produce a composite force component which moves from the dotted line position 62, shown in FIG. 9, in the direction of the arrow B. Eventually, as the pin 9 slides down the surface 57, the dotted line 62 will swing through the centre line of the pivot 18, whereupon there is no moment acting on the hook 17, about the pivot 18. Subsequently, the whole weight of the bucket pin 9 is supported on the second concave surface 61 on the interior of the nose portion 63 of the pin, whereupon the reaction force R2 disappears and the whole weight of the bucket is transferred to the bucket pin 92 to produce a reaction force R3, as shown in FIG. 10, which will result in a clockwise moment acting on the latching hook 17 about its support pivot 18, as represented by the arrow N. When this occurs, which is at the time when the pin 19 would appear to be at a position in which it was thought it would cause the latching hook 17 to move to its unlatched position, the weight of the bucket on the latching hook 17 in fact causes the latching hook not to move to an unlatching position, but to tend to move clockwise about its support pivot 18 to its latching position. This effectively means that if none of the safety systems previously described is correctly operating, it becomes impossible for the weight of the bucket to cause the latching hook to move to an unlatching position, because the shape of the internal surface of the newly provided tip portion 63 of the hook results in the moment N acting on the latching hook 17, always to move the latching hook 17 towards a latching position.

With the construction shown in FIGS. 9, 10 and 11, it is only possible to disconnect a bucket from the coupler in the manner previously described and illustrated in the various views of FIG. 12. In FIG. 12(1), the bucket piston and cylinder device 4 (not shown in this view) is fully retracted and the resiliently deformable leaf-spring 28 bears against an abutment on the dipper arm 3, and thus ensures that the blocking bar is kept in position against the hook 17. In FIG. 12(2), the bucket piston and cylinder device 4 has been partially extended and the blocking bar25 is kept in the correct position by gravity. FIG. 12(3) shows the position that the coupler 11 takes up after the bucket piston and cylinder device has been further extended and, when in this position, the blocking bar25 remains in its blocking position due to gravity. FIG. 12(4) shows the position taken by the coupler 11 when the bucket (not shown) is in the fully crowded position, i.e. the coupler is inverted. In this position, the blocking bar 25 will swing under gravity to an open position to allow the hook 17 to be retracted by operation of the piston and cylinder device 19. FIG. 12(5) shows the coupler 11 after it has been rolled to a position to allow the bucket pin 9 to swing clear of the coupler, whereas FIG. 12(6) shows how the bucket can then be removed by rolling the coupler 11 clockwise relative to its FIG. 12(5) position.

In other words, it is necessary first fully to rotate the coupler 11 anticlockwise about its mounting point 5 on the end of the dipper arm 5, through the position shown in FIG. 12(3) to the fully tucked position shown in FIG. 12(4), when the weight of the bucket is fully supported on the ground. It is then possible, because there is no longer any weight whatsoever of the bucket carried by the latching hook 17, to activate the piston and cylinder device 19 to swing the latching hook 17 to a fully unlatched position, as shown in the position of FIG. 12(4). The bucket can then be unlatched, as previously described and as illustrated by the positions shown in FIGS. 12(5) and 12(6).

It will, of course, be understood that the present invention has been described above purely by way of example, and modifications of detail can be made within the scope of the invention. For example, although the coupler is principally for coupling excavating buckets to the dipper arm, other attachments, such as concrete breakers, rippers and clamshells can be coupled to the dipper ann using the coupler, and the terms 'bucket' and 'buckets' should be interpreted accordingly. Furthermore, the coupler allows attachments from various different manufacturers in the same size excavator range to be used on a particular excavator.

Instead of the blocking means 25 i.e. the blocking bar with two limbs 26 or the bar 37, being moveable under its own weight by the force of gravity into its blocking position, and the resiliently deformable means 27 being provided to prevent the blocking means moving out of its blocking position when the coupler is inverted, by rotation in one sense about its mounting point 5, a spring 71 may be provided permanently to bias the blocking means 25 into its blocking position (see FIG. 13). This spring 71 is a coil spring extending between the protection plate 47 and the blocking means 25. In one arrangement, a wire and pulley arrangement 73 is provided, the wire of which would tighten when the coupler is inverted, i.e. on full curl of the bucket, to move the blocking means 25 out of its blocking position, against the bias of the spring 71.

In an alternative construction, a small hydraulic cylinder 75 could be provided to move the blocking means 25 out of its blocking position, and against the bias of the spring 71. Only then, could the piston and cylinder device 19 be operated to move the latching hook 17 to its bucket release position as shown in FIG. 13.

What is claimed is:

1. A coupler to enable an excavator operator to couple an excavator bucket to a dipper arm of an excavator without leaving his cab, the coupler comprising a first open-ended aperture, a second open-ended aperture and a movable latching member co-operating with said second open-ended aperture, the latching member including a locking face, power-operated means for moving the latching member between latched and unlatched positions; a control for the power operated means operable by the operator from the cab, and a bifurcated blocking bar, the two limbs of which are pivotally supported on a first pivot axis, and the opposite end of which is adapted to bear against said locking face the blocking bar moveable independently of the latching member from and into a blocking position in which it prevents the latching member from being disengaged.

2. A coupler to enable an excavator operator to couple an excavator bucket to a dipper arm of an excavator without leaving his cab, the coupler comprising a first open-ended aperture, a second open-ended aperture and a movable latching member including a locking face co-operating with said second open-ended aperture, power-operated means for moving the latching member between latched and unlatched positions; a control for the power operated means operable by the operator from the cab, and a single blocking bar pivotally supported at one end region on a first pivot axis and adapted to bear at its opposite end against said locking face and moveable about the first pivot axis independently of the latching member from and into a blocking position in which it prevents the latching member from being disengaged.

3. A coupler according to claim 3 wherein the locking face is stepped.

4. A coupler according to claim 4 wherein the locking face is stepped.

* * * * *

UNITED STATES PATENT AND TRADEMARK OFFICE

CERTIFICATE OF CORRECTION

PATENT NO. : 6,422,805 B1
DATED : July 23, 2002
INVENTOR(S) : Gary Miller

It is certified that error appears in the above-identified patent and that said Letters Patent is hereby corrected as shown below:

Title page,
Item [30], Foreign Application Priority Data, the correct serial number should read as -- 9819598.5 --.
Item [76], Inventor, second line should read as follows: -- Usworth, Washington, Tyne and Wear --

Signed and Sealed this

First Day of July, 2003

JAMES E. ROGAN
*Director of the United States Patent and Trademark Office*